US006799393B2

(12) United States Patent
Stephen

(10) Patent No.: US 6,799,393 B2
(45) Date of Patent: Oct. 5, 2004

(54) DOUBLE TROLLEY OVERHEAD DOOR OPERATOR

(75) Inventor: Erich P. Stephen, Roxboro (CA)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 0 days.

(21) Appl. No.: 10/236,845

(22) Filed: Sep. 6, 2002

(65) Prior Publication Data

US 2003/0093953 A1 May 22, 2003

Related U.S. Application Data

(60) Provisional application No. 60/322,060, filed on Sep. 12, 2001.

(51) Int. Cl.[7] ..... E05C 7/06

(52) U.S. Cl. ..... 49/118; 49/360; 49/409; 16/87 R

(58) Field of Search ..... 49/118, 116, 117, 49/366, 370, 404, 360, 409, 324, 362; 16/87 R, 91, 94 R, 95 R, 96 R, 87.4 R

(56) References Cited

U.S. PATENT DOCUMENTS

| | | | | | |
|---|---|---|---|---|---|
| 5,341,598 | A | * | 8/1994 | Reddy | 49/362 |
| 6,009,668 | A | * | 1/2000 | Reddy | 49/280 |
| 6,032,416 | A | * | 3/2000 | Springer et al. | 49/119 |
| 6,134,838 | A | * | 10/2000 | Reddy | 49/362 |
| 6,324,789 | B1 | * | 12/2001 | Stephen | 49/362 |

* cited by examiner

*Primary Examiner*—Hugh B. Thompson, II
(74) *Attorney, Agent, or Firm*—James Ray & Associates

(57) ABSTRACT

A door operator having a door hanger comprising a pair of double trolley assemblies disposed for linear movement within a hanger rail, wherein each trolley assembly further comprises two rollers mounted substantially opposite one another and engaging roller cavities within said hanger rail. Said door hanger is integrated with the drive system or is mounted independently of the drive system for replacement of the door hanger of the prior art or in new application requiring such independency between the door hanger and drive system.

33 Claims, 6 Drawing Sheets

DOUBLE TROLLEY OVERHEAD DOOR OPERATOR

CROSS-REFERENCE TO RELATED APPLICATIONS

This application is related to and claims priority from U.S. Provisional Patent Application Ser. No. 60/322,060 filed on Sep. 12, 2001. This application is also related to the invention disclosed in U.S. Pat. No. 6,032,416, titled "Transit Vehicle Door" and to the invention disclosed in U.S. Pat. No. 6,094,867, titled "Door Drive and Lock for Mass Transit Vehicle". The teachings of U.S. Pat. No. 6,032,416 and U.S. Pat. No. 6,094,867 are incorporated into this document by reference thereto.

FIELD OF THE INVENTION

The present invention relates to door system for passenger transit vehicles for covering and uncovering an aperture disposed within a sidewall of the transit vehicle for the ingress and egress of passengers through said aperture. More particularly, the present invention pertains to a door operator disposed within said door system having a load bearing and guiding combination element supporting the weight of the door(s) while enabling movement thereof with minimal friction.

BACKGROUND OF THE INVENTION

The following background information is provided to assist the reader to understand the environment in which the invention will typically be used. The terms used herein are not intended to be limited to any particular narrow interpretation unless specifically stated otherwise in this document.

Door systems for covering and uncovering an aperture disposed within a side wall of the transit vehicle are well know in the art of the passenger transit vehicle. As core elements, they comprise at least one door, at least one door operator attached to the structure of the passenger transit vehicle and connected to said at least one door, and a door support and guiding means connected to said at least one door for enabling the movement thereof in the opening and closing direction for at least partially uncovering and covering said aperture. The door support and guiding means are typically attached to the car structure but preferably are integral with the door operator. These door support and guiding means are also commonly referred to as a door hanger by those skilled in the art. Typically, the door hanger is used either in combination with a single door or a dual door configuration by containing a plurality of the guiding elements. From this point forward, a background discussion will be concerned with single door in combination with a single door hanger.

As stated above, the door hanger performs two main functions. The first function is related to support of the weight of the door and, therefore, support elements substantially attached to said door are disposed within said door hanger. These support elements, commonly referred to as door brackets or hanger brackets, are attached to the door with a well-known hardware elements.

The second function is related to enablement of the door movement when the prime mover disposed within door operator is energized and, therefore, guiding elements enabling movement of said door over a predetermined distance within said aperture are disposed within said door hanger.

It is generally well known in the passenger transit vehicle art to employ a door hanger having a hanger bracket encased around a substantially cylindrical hanger rod and further having a well-known recirculating linear ball bearing type disposed within the hanger bracket substantially engaging the hanger rod for linear movement thereof. The door hanger of type is disclosed in U.S. Pat. No. 6,032,416. Generally, the linear hanger rod is manufactured from a steel substrate and tempered to provide a predetermined surface hardness to prevent said surface of being damaged by the substantially cylindrical steel ball elements disposed within the interior cavity of said linear bearings. This combination requires the presence of lubricant generally applied to the surface of the hanger rod to reduce friction and component wear to an acceptable level for proper door operation. This type of door hanger is therefore susceptible to dirt and contamination present in the transit vehicle environment and requires frequent cleaning and lubricant replenishment to maintain desired level of friction and prevent premature component degradation due to wear. A linear bearing using a special seal to guard against contaminants is also well known in the art, however, the use of the seal increase friction of the door system requiring a larger prime mover to be employed in the door operator mechanism. The need for lubricant does not cooperate well with the latest trends in the art to employ a lubrication free door systems to substantially reduce the required periodic maintenance to clean and re-lubricate this type of door hangers. Furthermore, said linear bearings types cannot tolerate significant bending of the hanger rod caused by transversal or side loads due to the weight of the door and requires both the proper selection of the hanger rod size and placement of the hanger rod supports within the transit vehicle structure. And finally, the door hanger utilizing recirculating linear ball bearing and linear hanger rod is more expensive than the other type of door hangers, thus impacting the competitiveness of the overall door system.

A door hanger of a roller type disclosed in U.S. Pat. No. 6,094,867 overcomes the lubrication issue. A hanger bracket disclosed therein is affixed to the upper end of a door and connected to the drive mechanism. The door hanger bracket further includes at least two sets of longitudinally disposed vertically oriented pairs of cylindrically concave plastic rollers. The aforementioned vertical orientation provides upper and lower rollers in each pair. In operation, the upper and lower door hanger rollers cooperate with corresponding services in the semi-cylindrical hanger portion of the overhead mounted base plate, thereby providing low friction contamination resistant movement of the door panel when the rotary prime mover is energized and rotates the helical drive member. The upper rollers are generally substantially attached to the bracket and carry the weight of the door. The lower rollers generally incorporate adjustment features to provide proper running clearances with the semi-cylindrical hanger portion. The combination provides reciprocal travel of the attached door on the hanger portion of the base plate. Those skilled in the art will readily see that substantially vertical disposition of the rollers requires a car structure design of a similar vertically disposed type. This type of a car structure design is not available in all instances. Furthermore, the lower rollers are subject to inadvertent mis-adjustment creating either higher friction, if the rollers are over-adjusted in the upward direction, or unreliable motion if the rollers are over-adjusted in the downward direction.

A variation of this type of door hanger employs at least one single roller trolley assembly moving inside the hanger element having a cross-section similar to a letter "C" of the English alphabet. This type of door hanger generally requires complex linkage to provide interface with the drive system since the drive system is generally offset from the roller trolley assembly. It is generally preferable that this single roller trolley comprises two roller for equal weight distribution since the usage of the additional rollers may not result in equal weight distribution due to the manufacturing tolerances. As the result, the rollers and, more particularly the bearings disposed within these rollers must be of a sufficient size to assure proper load bearing capabilities.

It can be seen from the above discussion that there is a need for a reliable door hanger for transit vehicle, which substantially eliminates the need for lubricants and occupies a limited cross-sectional envelope of the vehicle structure. An additional need is to integrate load bearing hanger system with the drive system to both support the door and move it with minimal friction and at the required velocity while simplifying the interface between those two systems.

A substantial amount of transit vehicles manufactured during 1960s and 1970s employ independent door hanger and drive systems, wherein the drive system is located in the side wall of the transit vehicle or under a seat, while the door hanger is located overhead and attached directly to the car structure. Furthermore, the earlier door hanger designs employ circular ball of a bearing quality disposed within steel rails. This type of door hangers requires periodic lubrication and is extremely inefficient and exhibiting a high friction when there is a lack of such lubrication. There is a need for lubrication free door hanger capable of replacement the existing independent hanger of the old type.

SUMMARY

The present invention provides a door operator having a door hanger comprising a pair of double trolley assemblies disposed for linear movement within a hanger rail, wherein each trolley assembly further comprises two rollers mounted substantially opposite one another and engaging roller cavities within said hanger rail. Said door hanger is integrated with the drive system as described in the preferred embodiment or is mounted independently of the drive system for replacement of the door hanger of the prior art or in new applications requiring such independency between the door hanger and drive system.

The hanger rail is manufactured from an aluminum extrusion and hard anodized to prevent wear of the roller cavities upon engagement with the double trolley assemblies. The hanger rail further incorporates mounting provisions for the drive system members as well as for mounting to the transit vehicle structure.

Either a driving or driven trolley assembly contains two rollers attached to a trolley housing with retaining rings. The rollers are manufactured form self-lubricating nylon material providing low-friction operation as well as providing for lubrication free operation in combination with the hard anodized surface of the hanger rail. The rollers can either have a convex or concave outer surface cooperating with concave or convex roller cavities respectively disposed within hanger rail.

Each double trolley is attached to the door with a hanger bracket further providing rotational constraint of the drive nut when applied in the integrated mode.

The use of double trolleys enables equal door weight distribution to each roller eliminating the need for roller adjustment.

The door hanger can be also mounted independently of the drive system allowing replacement of the independent door hangers of the old type, while cooperating with the drive system of the old type, typically mounted in the side wall of the transit vehicle or under a seat of said transit vehicle.

OBJECTS OF THE INVENTION

It is, therefore, one of a primary objects of the present invention is to provide a door hanger system substantially eliminating the need for lubrication.

Another object of the present invention is to provide a door hanger system which minimizes friction forces during door movement.

A further object of the present invention is to provide a simplified interface between a door hanger system and a drive system.

Yet a further object of the present invention is to provide a door hanger system integrated with the drive system.

An additional object of the present invention is to provide reliable door hanger system.

In addition to the objects and advantages listed above, various other objectives and advantages of the invention will become more readily apparent to persons skilled in the relevant art from a reading of the detailed description section of this document. The other objects and advantages will become particularly apparent when the detailed description is considered along with the drawings and claims, if any, presented herein.

Figure 1:
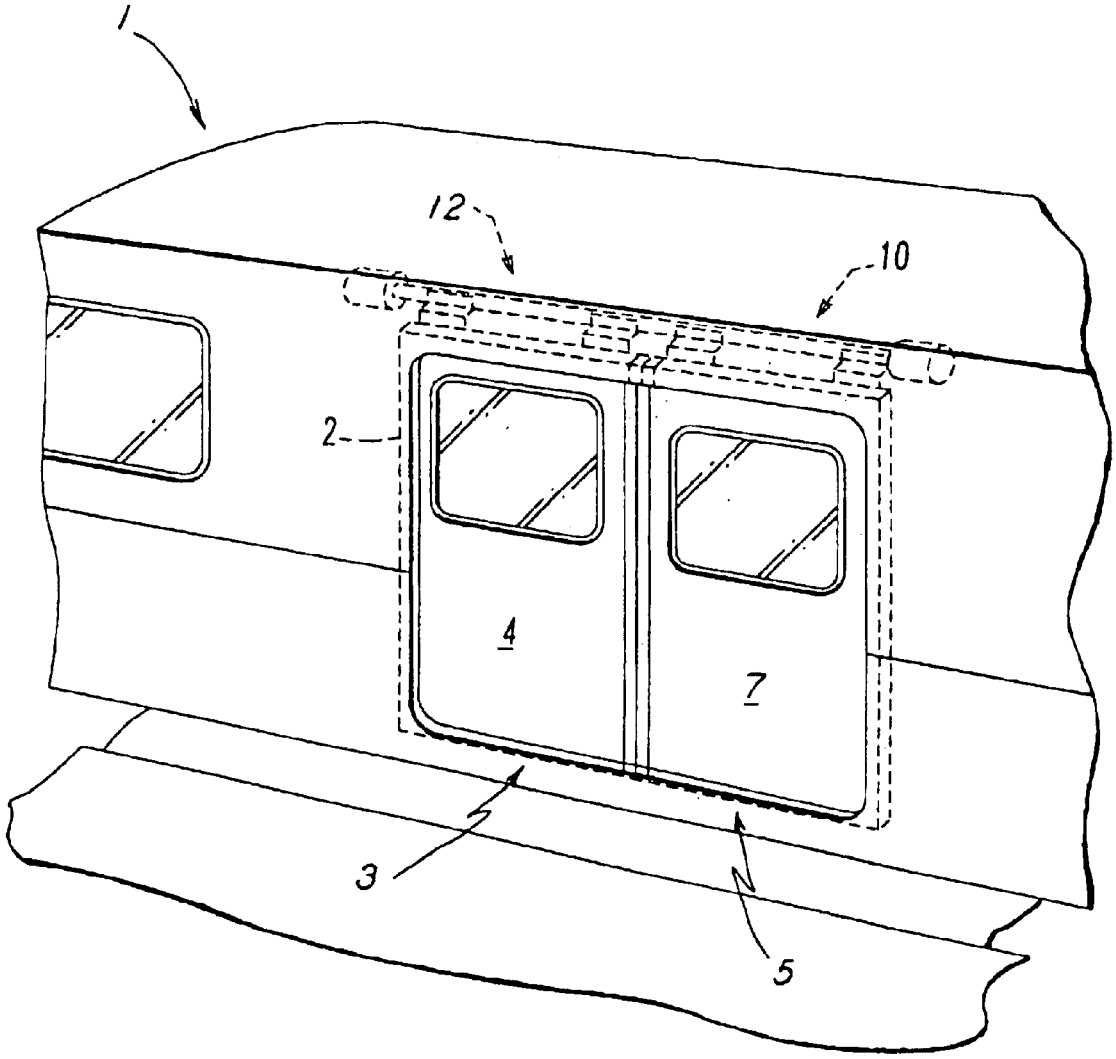
FIG. 1 is a partial perspective view of a typical transit vehicle body, particularly showing door systems of a bi-parting configuration within an aperture disposed in the sidewall of the transit vehicle.

DETAILED DESCRIPTION OF THE PRESENTLY PREFERRED AND VARIOUS ALTERNATIVE EMBODIMENTS OF THE INVENTION

Before describing the invention in detail, the reader is advised that, for the sake of clarity and understanding, identical components having identical functions have been marked where possible with the same reference numerals in each of the FIGURES provided in this document.

The invention disclosed herein largely overcomes the above discussed difficulties through the use of a door operator having a door hanger comprising a pair of double trolley assemblies disposed for linear movement within a hanger rail, wherein each trolley assembly further comprises two rollers mounted substantially opposite one another and engaging roller cavities within said hanger rail. Said door hanger is integrated with the drive system as described in the preferred embodiment or is mounted independently of the drive system for replacement of the door hanger of the prior art or in new applications requiring such independency between the door hanger and drive system.

With respect to FIG. 1, there is shown a partial view of a "typical" transit vehicle, generally designated 1, having a door aperture 2. The transit vehicle 1 comprises a powered door system, generally designated 3, disposed within aperture 2, having a door 4 driven by door operator, generally designated 12 disposed substantially overhead of said door 4. Said vehicle further comprises a powered door system, generally designated 5, having door 7 driven by a door operator, generally designated 10 disposed substantially overhead of said door 7. Said doors 4 and 7 are disposed in a bi-parting configuration for at least partially covering and uncovering said aperture 2 in such transit vehicle 1.

Said door operators 10 and 12 disposed substantially overhead of such doors 7 and 4 respectively enable said motion of such door 7 and 4 to at least partially covering and uncovering said aperture 2 in such transit vehicle 1. As such door operators 10 and 12 are identical, the following description will be concerned with operator 10 as those skilled in the art will readily understand that operation of the doors operator 12 is identical other than the direction of motion.

Figure 2:
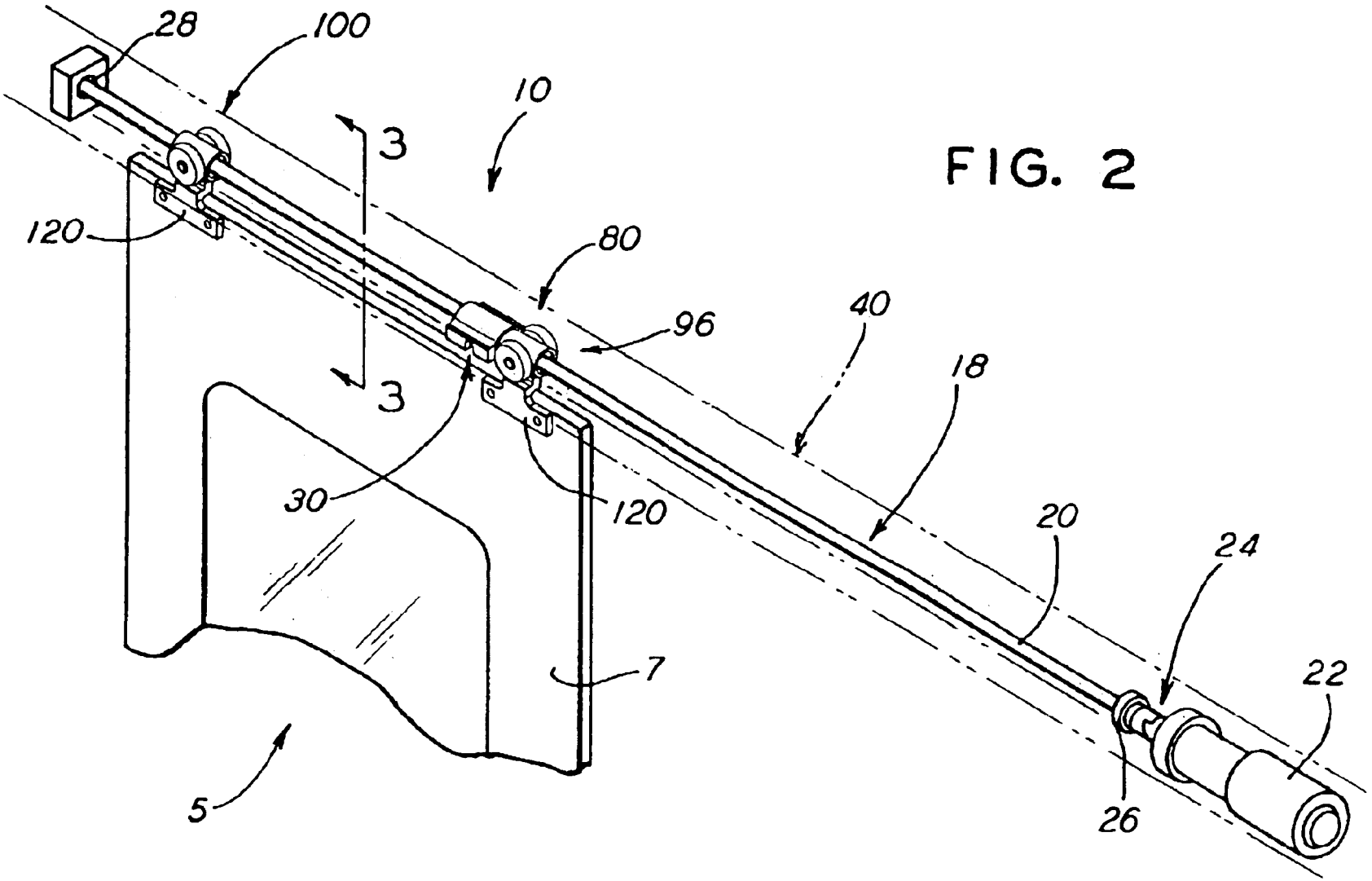
FIG. 2 is a perspective view of the door operator incorporating an integral door hanger system.

In the presently preferred embodiment shown in FIG.2, door operator 10 comprises a drive system, generally designated 18, having a helical drive member 20 substantially rotatably mounted using prime a mover 46 coupled to said helical drive member 20 with a coupling means 24 and a coupling flange 26 at one end and is supported by a bearing 28 at the distal end. The coupling means 24 could be of a well-known universal joint type, but preferably is of a flexible coupling type, compensating for a misalignment between said helical drive member 20 and such prime mover 22 at a reduced cost. Yet alternatively, said helical drive member 20 can be directly connected to such prime mover 22 within door operators where substantial alignment can be achieved through precise mounting of such members. A drive nut 30, having a first predetermined outer diameter and further having at least one force transmitting member 31 (not shown) engages such helical drive member 20 to be driven thereby upon rotation of such helical drive member 20 enabled by the rotary prime mover 22.

Figure 3:
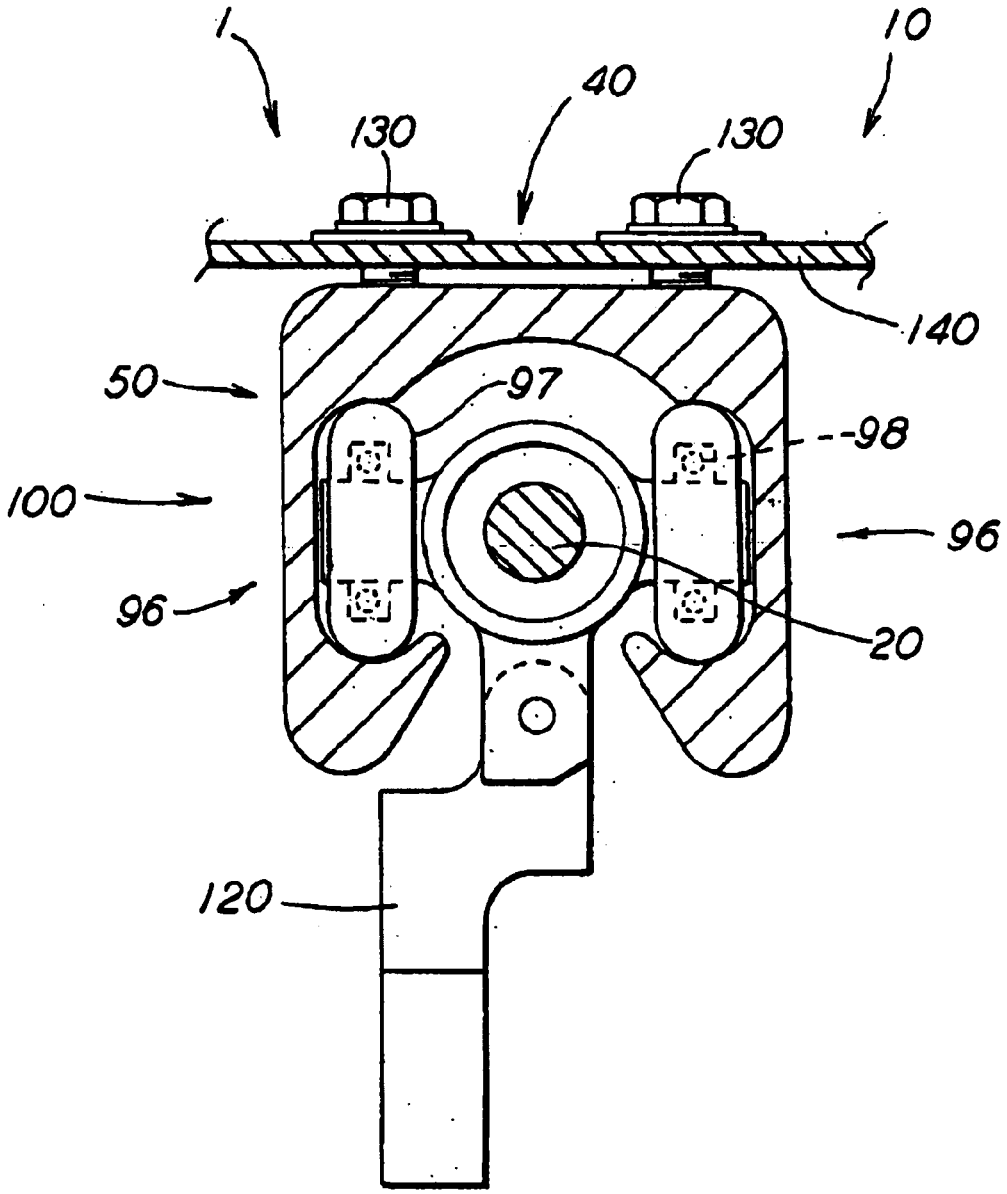
FIG.3 is a planar cross-sectional view of the door operator shown in FIG. 2 taken along the lines 3—3 and showing trolley assembly disposed within hanger rail.

In further reference to FIGS. 2 and 3, there shown a door hanger, generally designated 40, comprising a hanger rail, generally designated 50, a driving trolley assembly, generally designated 80, and a driven trolley assembly, generally designated 100. Said driving trolley assembly 80 and said driven trolley assembly 100 are connected to said door 7 using at least one hanger bracket, generally designated 120, best shown in FIG. 8. In the preferred embodiment, said at least one hanger bracket 120 is a two hanger bracket 120 equally disposed about such door 7.

Figure 5:
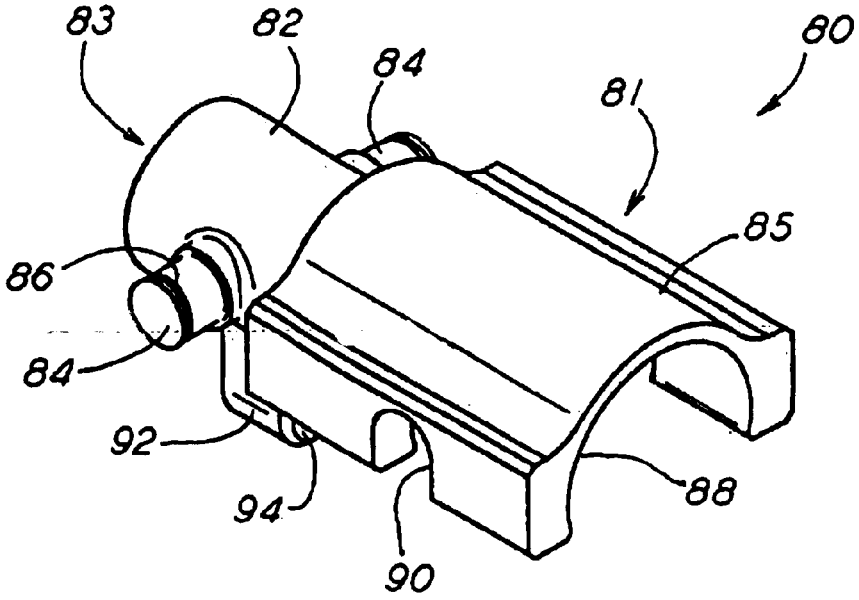
FIG. 5 is a perspective view of the driving trolley bracket.

Driving trolley assembly 80 comprises a driving trolley housing, generally designated 81, best shown in FIG. 5, and at least two rollers, generally designated 96, disposed substantially opposite one another at each side of such driving trolley housing 81 and substantially retained with a well-known retaining rings 118. Said roller 96 further comprises a bearing means 98 disposed within roller housing 97 having preferably a convex outer surface of a third predetermined diameter. The roller housing 97 is preferably manufactured form a self-lubricating nylon material. Alternatively, other materials having a low friction coefficient can be used to manufacture such roller housing 97. Said bearing means 98 could be a well-known self-lubricating bushing, but preferably is a well-known ball bearing.

The driving trolley housing 81 comprises a first body portion 82 having a first cylindrical cavity 83, at least two substantially cylindrical roller mounting portions 84 disposed substantially opposite one another about said first body portion 82. Each roller mounting portions 84 contains a retaining ring mounting cavity 86. A second body portion 85 having a second semi-cylindrical cavity 88 of a second predetermined diameter disposed substantially concentric said first cylindrical cavity 83 for engagement with the drive nut 30. Preferably said second predetermined diameter of such second cylindrical cavity 88 is substantially equal to said first predetermined diameter of the drive nut 30. At least one force receiving member 90 is disposed within said second body portion 85 engages said force transmitting member 31 (not shown) to transfer linear motion generated by said drive nut housing 30 to said driving trolley assembly 80. The force receiving members 90 further provide rotational constraint in order to prevent said drive nut 30 from rotating about an axis of said helical drive member 20. Said driving trolley housing 81 further comprises at least one force transmitting portion 92 having a vertical displacement compensation cavity 94 for transferring linear motion to the hanger bracket 120 and, more particularly enabling movement of said door 7.

The driving trolley housing 81 can be made from a variety of the available materials and manufactured by the variety of methods, but preferably is made from a stainless steel and having a first predetermined structural strength of the first body portion 82 and second body portion 85 in combination with said first cylindrical cavity 83 and said second semi-cylindrical cavity 88, said first predetermined structural strength capable of supporting at least partial weight of the door 7, and manufactured by a well-known casting method to provide tolerance control and economy of cost.

Figure 4:
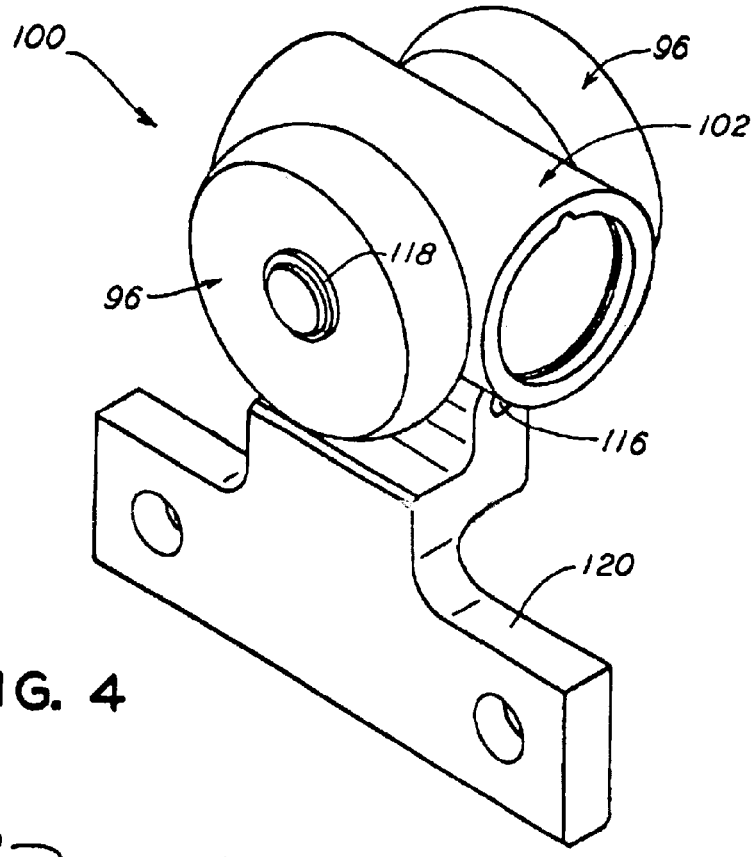
FIG. 4 is a perspective view of the driven trolley assembly in combination with the hanger bracket.
Figure 6:
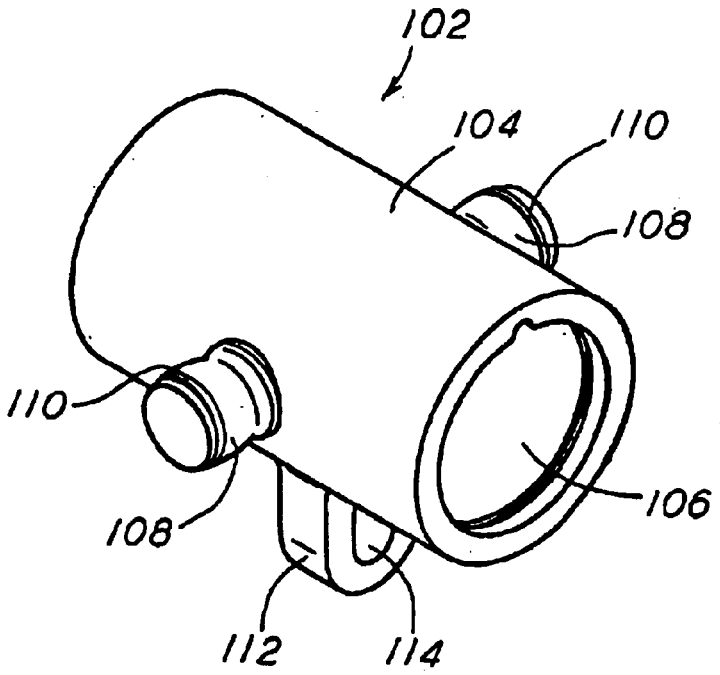
FIG. 6 is a perspective view of the driven trolley bracket.

The driven trolley assembly 100, best shown in FIGS. 2 and 4, comprises a driven trolley housing, generally designated 102, best shown in FIG. 6 and at least two rollers 96, disposed substantially opposite one another at each side of such driven trolley housing 102 and substantially retained with well-known retaining rings 118.

The driven trolley housing 102 comprises a body portion 104 having a third cylindrical cavity 106, at least two substantially cylindrical roller mounting portions 110 disposed substantially opposite one another about said body portion 102. Each roller mounting portions 102 contains a retaining ring mounting cavity 110. Said driven trolley housing 102 further comprises at least one force transmitting portion 112 having a vertical displacement compensation cavity 114 for transferring linear motion to the hanger bracket 120 and, more particularly further enabling movement of said door 7.

The driven trolley housing 102 can be made from a variety of the available materials and manufactured by the variety of methods, but preferably is made from a stainless steel to provide a second predetermined structural strength of the body portion 104 in combination with said third cylindrical cavity 106, said second predetermined structural strength capable of supporting at least partial weight of the door 7, and manufactured by a well-known casting method to provide tolerance control and economy of cost.

Figure 7:
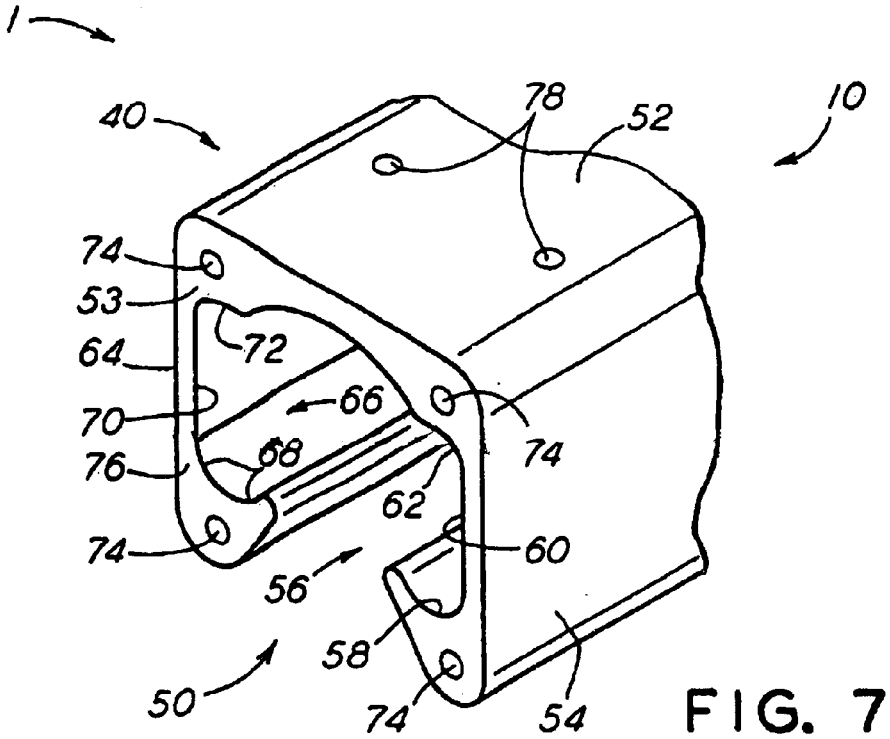
FIG. 7 is a partial perspective view of the hanger rail.

The hanger rail 50, best shown in FIG. 7, a first roller portion 54 having a first roller cavity 56, and second roller portion 64 having a second roller cavity 66, said second roller portion 64 disposed substantially opposite said first roller cavity 56 and a mounting surface portion 52 disposed intermediate said first roller portion 54 at one end and said second roller portion 64 at a distal end. The first roller cavity 56 further comprises a first wall portion 60 disposed intermediate a first concave portion 58 at one end a second concave portion 62 at a distal end. The second roller cavity 66 further comprises a second wall portion 70 disposed intermediate a third concave portion 68 at one end a forth concave portion 72 at a distal end. Those skilled in the art will easily recognize that the first roller cavity 56 and the second roller cavity 66 are identical except for orientation within hanger rail 50, wherein said second roller cavity 66 is facing the first roller cavity 56.

As those skilled in the art can further see, the employment of separate driving and driven trolley assemblies, 80 and 100 respectively, each having two rollers 96 substantially disposed opposite one another and moving in the first and second roller cavities 56 and 66 respectively enables substantially equal distribution of the weight of door 7 among each roller 96 and further enables substantially continuous engagement of each roller 96 with the first concave cavity 58 or third concave cavity 68 in order to substantially maintain said engagement during the movement of said door 7 to at least partially cover and uncover said aperture 2. This substantial engagement substantially eliminates the need for roller 96 adjustments and, more particularly, increases overall reliability of door hanger 40.

As best shown in FIG. 3, the first concave portion 58 and the third concave portion 68 are disposed inwardly within hanger rail 50 enabling movement of the plurality of rollers 96 in a semi-enclosed environment and further shielding said plurality of rollers 96, said helical drive member 20 and said drive nut 30 from a dirt and other contaminants within the environment of transit vehicle 1.

Figure 9:
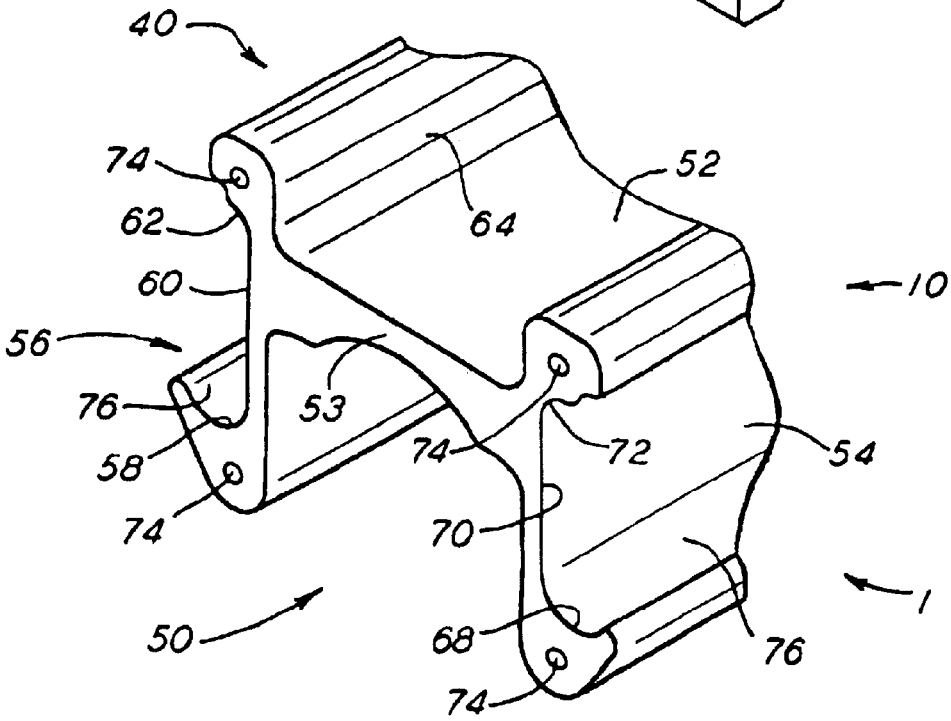
FIG. 9 is a partial perspective view of the hanger rail of an alternative design.

The need arises due to a particular car structure design of transit vehicle 1 in a combination with the increased weight of the door 7, or based on the preference of a particular Authority to monitor the structural integrity of said plurality of rollers 69 and the ease of said plurality of rollers 96 replacement, wherein said plurality of rollers 96 are to be exposed to the environment. Therefore, in the alternative embodiment shown in FIG. 9, said first concave portion 58 and the third concave portion 68 are disposed outwardly within the hanger rail 50 enabling an access to said plurality of rollers 96.

In the preferred embodiment said hanger rail 50 is manufactured from aluminum material by an extrusion process and having a third predetermined structural strength capable of supporting the weight of door 7, weight of the drive system 18 and weight of the driving trolley assembly 80 and driven trolley assembly 100 in combination. A wear resistant means 76, manufactured by an anodizing process, but preferably, manufactured by a hard anodizing process, are disposed within said hanger rail 50 and, more particularly, disposed within said first roller cavity 56 and said second roller cavity 66 to substantially eliminate surface wear due to a continuous contact by the plurality of rollers 96. Said wear resistant means 76 in combination with self-lubricating material of the roller housing 97 enable lubrication free, low friction movement of the door 7.

At least two threaded cavities 74 are disposed within the first end portion 53 of said hanger rail 50 for attachment of the prime mover 22 and coupling flange 26 with well-known threaded fasteners. In the preferred embodiment said at least two threaded cavities 74 are four threaded cavities 74 symmetrically disposed within end portion 53. Furthermore, at least one cavity 74 is disposed within a second end portion 55 (not shown) for attachment of the bearing 55 supporting the distal end of said drive member 20. Said door hanger 40, therefore, enables integral attachment of said drive system 18.

Figure 8:
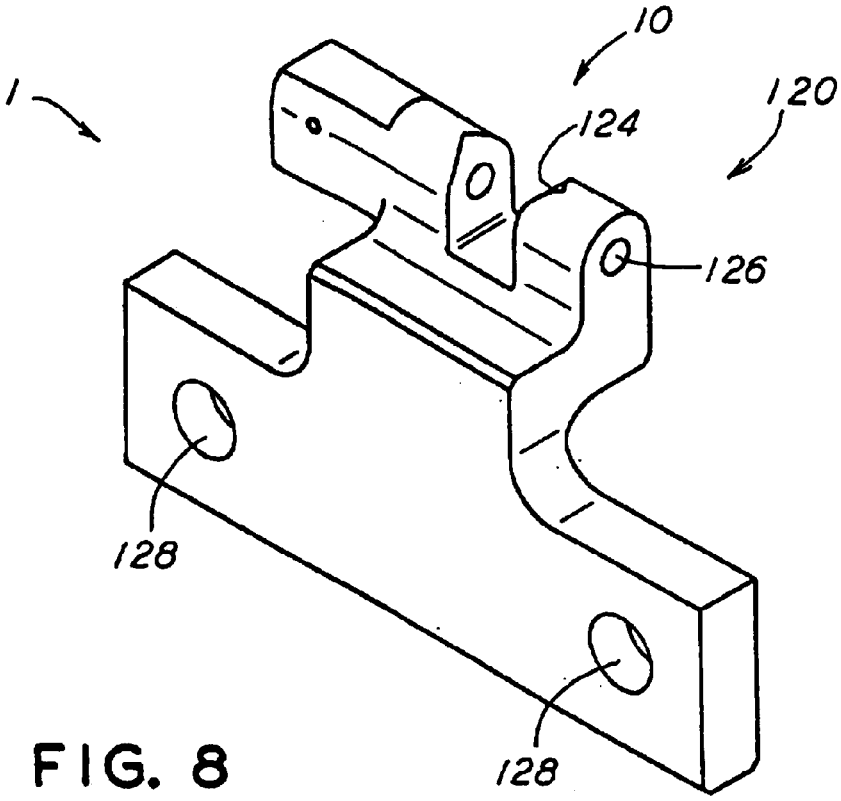
FIG. 8 is a perspective view of the hanger bracket.

The hanger bracket 120, best shown in FIG. 8, comprises a force receiving portion 124 for engagement with said force transmitting portion 92 or said force transmitting portion 112, a first cavity 126 for retainment of said force transmitting portion 92 or said force transmitting portion 112 with a simple pin member 116, best shown in FIG. 4, and at least one mounting means 128 for attachment to said door 7. In the preferred embodiment said at least one mounting means 128 is a two cavity 128 for attachment to said door 7 with well-known fasteners.

The rotation of the drive member 20, when the prime mover 22 is energized, enables the movement of said drive nut 30 and, more particularly, enables the driving trolley assembly 80 engaging said drive nut 30 to transfer the movement to said door 7 through hanger bracket 120. Said driving trolley assembly 80 in a combination with the hanger bracket 120 further provides linear constraint of said drive nut 30 along such axis of said helical drive member 20 so that rotation of said helical drive member 20 causing motion of said drive nut 30 parallel to such axis of said helical drive member 20 causes movement of said door 7 substantially parallel to such drive direction.

The driven trolley assembly 100, substantially connected to said door 7 cooperates with the driving trolley assembly 80 to move the weight of the door 7 in the driving direction. Those skilled in the art will readily see that the double trolley arrangement within each driving trolley assembly 80 and driven trolley assembly 100, wherein the weight of the door 7 is substantially equally carried by each roller 96 enables to select a roller with a reduced third predetermined diameter as compared with having only one roller 96 within driving trolley assembly 80 or driven trolley assembly 100. The design, therefore, enables to employ a hanger rail 50 of a reduced cross-section further enabling door operator installation in a limited car structure envelop of the transit vehicle 1.

In the preferred embodiment of a present invention the helical drive member 20 is disposed within cavities 83 and 106 of the driving trolley assembly 80 and a driven trolley assembly 100 respectively, further reducing the required space envelope as compared with the prior art. Said combination further enables substantial integration of the door hanger 50 with the drive system 18 simplifying the interface between said door hanger 40 and said drive system 18.

Furthermore, in the preferred embodiment of the present invention, said roller 96 having the convex outer surface moves linearly in the first concave portion 58 of the first roller cavity 56 and in the second concave portion 68 of the second roller cavity 66 respectively. Alternatively, a reversed configuration, wherein a roller 96 having a concave outer surface moving in a first convex portion 58 of the first roller cavity 56 and in a second convex portion 68 of the second roller cavity 66 respectively results in a substantially identical movement of said door 7.

As it can be best seen in FIGS. 3 and 7, at least two mounting means 78 are disposed within said hanger rail 50 for substantial attachment to the structure member 140 of the transit vehicle 1 with the well-known threaded fasteners 130. In the preferred embodiment said at least two mounting means are at least two cavities 78 disposed within said mounting surface portion 52. Alternatively, said at least two mounting cavities 78 can be disposed within first roller portion 54 or second roller portion 64. Yet alternatively, additional members can be attached to said hanger rail 50 for further mounting to the car structure member 140. The door hanger 40, therefore, is capable of being mounted independently of the drive system in a transit vehicle 1, enabling replacement of the previously mounted independent door hangers while utilizing the previously mounted drive system, wherein said door hanger 40 is mounted overhead of said door 7.

Those skilled in the art can easily see that independently mounted door hanger 40 employs a pair of driven trolley assemblies 100 to reduce component variation and further reduce door hanger costs.

Those skilled in the art can further easily see that a single door hanger 40 can be used with the door 4 and door 7 in combination by employing at least two driving trolley assemblies 80 and at least two driven trolley assemblies 100 when said door hanger 40 is integral with the drive system 18 having a second helical drive member 20 and a second drive nut member 30, or said door hanger 40 employing at least four driven trolley assemblies 100 when independently mounted within the transit vehicle 1.

Thus, the present invention has been described in such full, clear, concise and exact terms as to enable any person skilled in the art to which it pertains to make and use the same. It will be understood that variations, modifications, equivalents and substitutions for components of the specifically described embodiments of the invention may be made by those skilled in the art of transit vehicle drive nut without departing from the spirit and scope of the invention as set forth in the appended claims.

I claim:

1. A powered door system disposed within an aperture of a transit vehicle structure for at least partially covering and uncovering said aperture, said powered door system comprising:

(a) a door (b) a powered door operator attached to said door for driving said door in a drive direction to cover and uncover said aperture, said door operator mounted substantially overhead of said door; said door operator attached to said transit vehicle structure; said door operator having a drive system and a door hanger integral with said drive system, said door hanger connected to said door for driving said door in a drive direction by said drive system, said door hanger includes:

(i) a hanger rail having a first roller portion having a first roller cavity; a second roller portion having a second roller cavity, said second roller cavity disposed substantially opposite said first roller cavity; and a mounting surface portion disposed intermediate said first roller portion at one end and said second roller portion at a distal end;

(ii) a driving trolley assembly engageable with said drive nut, said driving trolley assembly adapted for movement within said hanger rail;

(iii) a driven trolley assembly, said driven trolley assembly adapted for movement within said hanger rail; and (iv) at least one hanger bracket attached to said door, said at least one hanger bracket attached to one of said driving trolley assembly and said driven trolley assembly.

2. The powered door system according to claim 1, wherein said drive system further includes:

(a) a prime mover;

(b) a helical drive member attached to said prime mover at one end, said drive member being aligned substantially parallel to said drive direction;

(c) a bearing engaging said helical drive member at a distal end;

(d) a coupling means disposed intermediate said helical drive member and said prime mover, said coupling means connecting said helical drive member with said prime mover; and (e) a drive nut having a first predetermined diameter, said drive nut engaging said helical drive member; said drive nut is driven thereby in a linear direction upon rotation of said helical drive member enabled by said prime mover, said drive nut having a force transmitting member.

3. The powered door system according to claim 2, wherein said coupling means is at least one of a type coupling and a universal joint.

4. The powered door system according to claim 1, wherein said helical drive member is directly connected to said prime mover.

5. The powered door system according to claim 1, wherein said first roller cavity includes:

(a) a first concave portion;

(b) a second concave portion; and (c) a first wall portion disposed intermediate said first concave portion at one end and said second concave portion at a distal end.

6. The powered door system according to claim 5, wherein said second roller cavity includes:

(a) a third concave portion;

(b) a fourth concave portion; and (c) a second wall portion disposed intermediate said third concave portion at one end and said forth concave portion at a distal end.

7. The powered door system according to claim 5, wherein said roller having said convex outer surface of a third predetermined diameter engages said first concave portion of said first roller cavity, said roller having said convex outer surface of a third predetermined diameter further engages said third concave portion of said second roller cavity.

8. The powered door system according to claim 5, wherein said roller having said concave outer surface of a third predetermined diameter engages said first convex portion of said first roller cavity, said roller having said concave outer surface of a third predetermined diameter further engages said third convex portion of said second roller cavity.

9. The powered door system according to claim 1, wherein said first roller cavity includes:

(a) a first convex portion;

(b) a second convex portion; and (c) a first wall portion disposed intermediate said first convex portion at one end and said second convex portion at a distal end.

10. The powered door system according to claim 9, wherein said second roller cavity includes:

(a) a third convex portion;

(b) a fourth convex portion; and (c) a second wall portion disposed intermediate said third convex portion at one end and said forth convex portion at a distal end.

11. The powered door system according to claim 1 wherein said first roller cavity is substantially identical to said second roller cavity.

12. The powered door system according to claim 1, wherein said first roller cavity is one of inwardly disposed and outwardly disposed within said hanger rail.

13. The powered door system according to claim 1, wherein said second roller cavity is one of inwardly disposed and outwardly disposed within said hanger rail.

14. The powered door system according to claim 1, wherein said hanger rail further includes a wear resistant means disposed within said hanger rail, said wear resistant means substantially eliminating surface wear due to contact by said first trolley assembly, said wear resistant means further substantially eliminating surface wear due to contact by said second trolley assembly.

15. The powered door system according to claim 14, wherein said wear resistant means is produced by one of an anodizing process and a hard anodizing process.

16. The powered door system according to claim 1, wherein said hanger rail is manufactured by an aluminum extrusion process, said hanger rail having a third predetermined structural strength to support said door and said drive system and said plurality of trolley assemblies.

17. The powered door system according to claim 1, wherein said hanger rail further includes a mounting means for attachment to said transit vehicles structure.

18. The powered door system according to claim 1, wherein said driving trolley assembly includes:

(a) a driving trolley housing having at least two substantially cylindrical roller mounting portions disposed within a first body portion; said first body portion having a first cylindrical cavity;

(b) at least two rollers engaging said two substantially cylindrical roller mounting portions disposed within said first body portion of said driving trolley housing, said at least two rollers disposed substantially opposite each other; and (c) at least two retaining rings engaging said two substantially cylindrical roller mounting portions disposed within said first body portion of said driving trolley housing; said retaining rings are for substantial retainment of said at least two rollers thereof.

19. A powered door system according to claim 18, wherein said driving trolley housing further includes:

(a) a second body portion connected to said first body portion;

(b) a second semi-cylindrical cavity disposed within said second body portion; said second semi-cylindrical cavity having a second predetermined diameter; said second predetermined diameter substantially equal to said first predetermined diameter of said drive nut;

(c) a force receiving member disposed within said second body portion, said forth receiving member engaging said force transmitting member disposed within said drive nut; and (d) a force transmitting portion having a vertical displacement compensation cavity for transferring linear motion generated by said drive nut to said hanger bracket, said force transmitting portion having a vertical displacement compensation cavity for transferring linear motion generated by said drive nut to said door.

20. The powered door system according to claim 19, wherein said driving trolley housing is manufactured from a stainless steel, said driving trolley housing having a first predetermined structural strength of said first body portion and second body portion in combination with said first cylindrical cavity and said second semicylindrical cavity, said first predetermined structural strength capable of supporting at least partial weight of said door.

21. The powered door system according to claim 18, wherein said roller having a bearing means disposed within a roller housing having a convex outer surface of a third predetermined diameter.

22. The powered door system according to claim 1, wherein said driven trolley assembly includes:

(a) a driven trolley housing having at least two substantially cylindrical roller mounting portions disposed within a body portion; said body portion having a third cylindrical cavity;

(b) at least two rollers engaging said at least two substantially cylindrical roller mounting portions disposed within said body portion of said driven trolley housing, said at least two rollers disposed substantially opposite each other; and (c) at least two retaining rings engaging said at least two substantially cylindrical roller mounting portions disposed within said body portion of said driven trolley housing; said at least two retaining rings are for substantial retainment of said at least two rollers thereof.

23. The powered door system according to claim 22, wherein said driven trolley housing further includes at least one force transmitting portion disposed within said body portion having a vertical displacement compensation cavity for transferring said linear motion to said hanger bracket, said at least one force transmitting portion having a vertical displacement compensation cavity for transferring linear motion generated by said drive nut to said door.

24. The powered door system according to claim 1, wherein said powered door system includes a pair of hanger brackets equally spaced on said door, said pair having a first hanger bracket attached to said driving trolley assembly at one end of said door, said pair having a second hanger brackets attached to said driven trolley assembly at the distal end of said door.

25. The powered door system according to claim 1, wherein said at least one hanger bracket prevents said drive nut from rotating about an axis of said helical drive member, said at least one hanger bracket, further providing linear constraint of said drive nut along said axis of said helical drive member between said drive nut and said door so that rotation of said helical drive member causing motion of said drive nut parallel to said axis of said helical drive member causes movement of said door parallel to said drive direction.

26. A powered door system disposed within an aperture of a transit vehicle structure for at least partially covering and uncovering said aperture, said powered door system comprising:

(a) a door (b) a powered door operator having a connection to said door for enabling said door to move in a drive direction to cover and uncover said aperture, said door operator mounted substantially overhead of said door; said door operator attached to said transit vehicle structure; and (c) a door hanger connected to said door for driving said door in a drive direction, said door hanger attached to said transit vehicle structure; said door hanger includes:

(i) a hanger rail having a first roller portion with a first roller cavity; a second roller portion with a second roller cavity, said second roller cavity disposed substantially opposite said first roller cavity; and a mounting surface portion disposed intermediate said first roller portion at one end and said second roller portion at a distal end;

(ii) at least one trolley assembly disposed for movement within said hanger rail; and (iii) at least one hanger bracket substantially attached to said door, said at least one hanger bracket attached to said at least one trolley assembly.

27. The powered door system according to claim 26, wherein said powered door system includes a pair of trolley assemblies equally disposed about said door.

28. The powered door system according to claim 26, wherein said powered door system includes two hanger brackets equally spaced on said door.

29. The powered door system according to claim 26, wherein said first roller cavity includes:

(a) a first concave portion;

(b) a second concave portion; and (c) a first wall portion disposed intermediate said first concave portion at one end and said second concave portion at a distal end.

30. The powered door system according to claim 29, wherein said second roller cavity includes:

(a) a third concave portion;

(b) a fourth concave portion; and (c) a second wall portion disposed intermediate said third concave portion at one end and said forth concave portion at a distal end.

31. The powered door system according to claim 26, wherein said first roller cavity includes:

(a) a first convex portion;

(b) a second convex portion; and (c) a first wall portion disposed intermediate said first convex portion at one end and said second convex portion at a distal end.

32. The powered door system according to claim 31, wherein said second roller cavity includes:

(a) a third convex portion;

(b) a fourth convex portion; and (c) a second wall portion disposed intermediate said third convex portion at one end and said forth convex portion at a distal end.

33. A door hanger enageable with a door of a transit vehicle, disposed within an aperture of a transit vehicle structure, said door hanger enabling movement of said door for at least partially covering and uncovering said aperture, said door hanger comprising:

(a) a hanger rail having a first roller portion with a first roller cavity; a second roller portion with a second roller cavity, disposed substantially opposite said first roller cavity; and is rigidly connected thereto;

(b) at least one trolley assembly adapted for movement within said hanger rail, said at least one trolley assembly having a housing with at least two roller mounting portions disposed thereon, at least two rollers coupled to said at least two roller mounting portions, said at least two rollers engaging said first roller portion and said second roller portion, and a means for substantially retaining said at least two rollers on said housing during said movement of said door;

(c) at least one hanger bracket substantially attached to said door, and to said at least one trolley assembly; and (d) wherein said at least one hanger bracket includes a mounting means for engaging such transit vehicle structure.

* * * * *